United States Patent [19]

Martin

[11] 3,937,912

[45] Feb. 10, 1976

[54] PRESSURE RESPONSIVE CIRCUIT CONTROL UNIT HAVING ADJUSTABLE, INTERCHANGEABLE ACTUATOR COMPONENTS AND CAM-OPERATED SWITCH

[75] Inventor: Clyde J. Martin, Cincinnati, Ohio

[73] Assignee: Martin Industries, Inc., Cincinnati, Ohio

[22] Filed: Sept. 30, 1974

[21] Appl. No.: 510,435

[52] U.S. Cl. ..... 200/82 C; 73/419; 200/56 R; 200/153 LA

[51] Int. Cl.[2] ..... H01H 35/38

[58] Field of Search ..... 137/557; 74/568 R; 403/31, 403/341, 396; 92/5 A; 340/229, 240; 73/389, 419; 200/153 T, 81 R, 81.4, 56 R, 82 R, 82 C, 82 D, 82 A, 308, 153 LA

[56] References Cited

UNITED STATES PATENTS

| | | | |
|---|---|---|---|
| 2,418,508 | 4/1947 | Goepfrich | 200/82 C |
| 2,437,440 | 3/1948 | Rigden | 200/56 R |
| 3,472,977 | 10/1969 | Ziegler, Jr. | 200/153 LA |
| 3,576,529 | 4/1971 | Garrison | 200/153 LA |
| 3,703,616 | 11/1972 | Martin | 200/56 R |
| 3,789,669 | 2/1974 | Passman | 73/419 |

*Primary Examiner*—Gerald P. Tolin

*Attorney, Agent, or Firm*—J. Warren Kinney, Jr.

[57] ABSTRACT

The circuit control unit of the present invention comprises a piston-type pressure responsive member or gauge wherein one end of the piston extends beyond the gauge body and carries an actuator which is movable with the piston. A circuit control member is mounted for actuation by the actuator for controlling an external electrical circuit in response to changes in fluid pressure as detected by the pressure responsive member. Where desired, an indicator may be mounted in fixed relationship with the pressure responsive member, providing means for visibly indicating the pressure of the fluid and the position of the piston with respect to the pressure responsive member.

12 Claims, 7 Drawing Figures

FIG-3
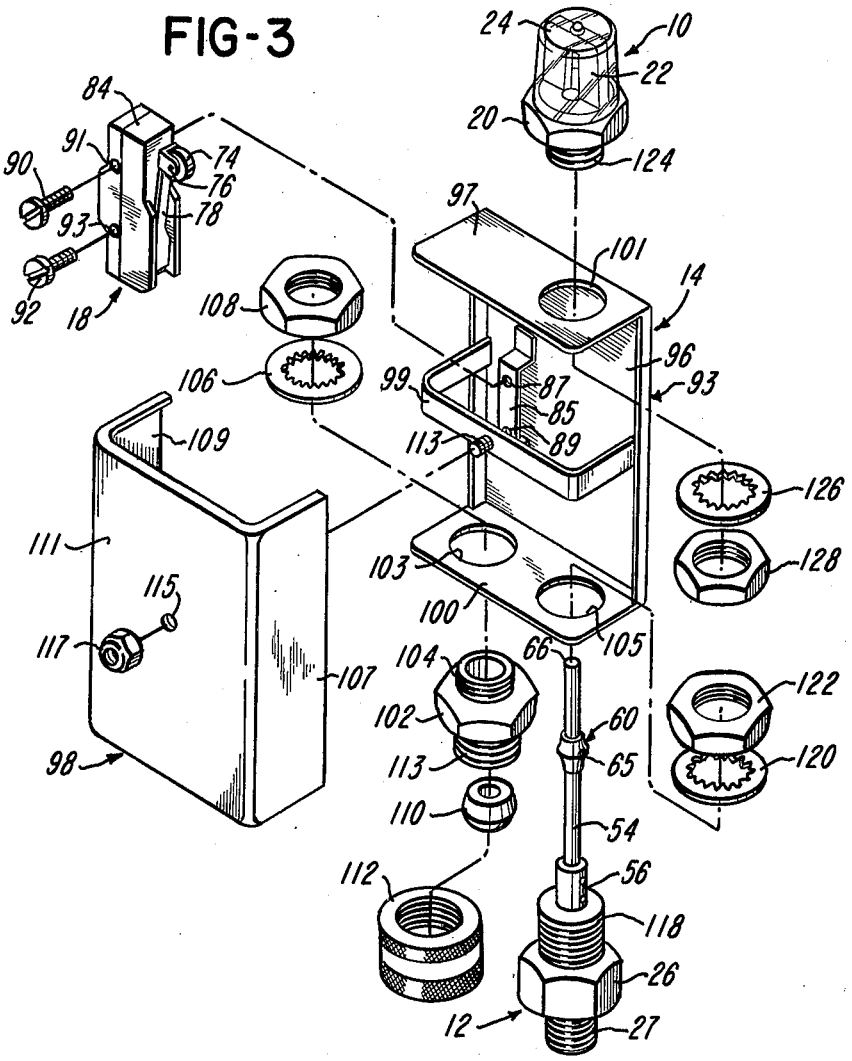
FIG-6
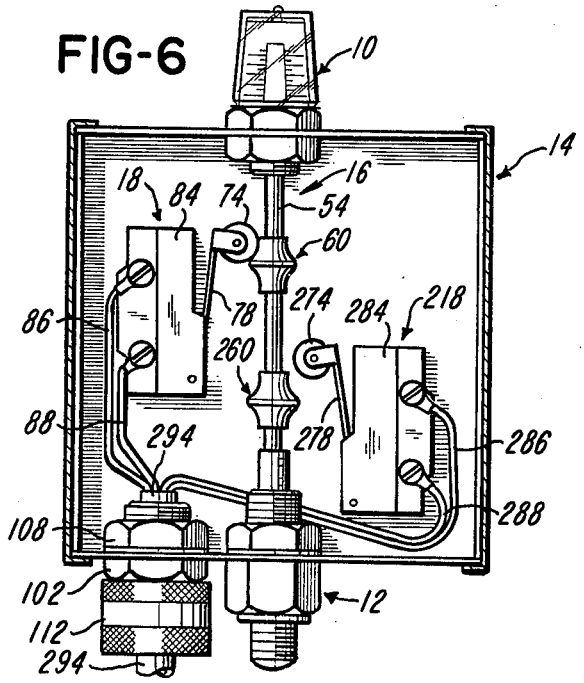
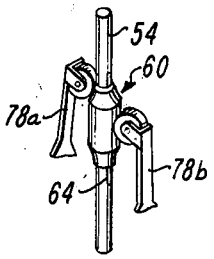
FIG-7

PRESSURE RESPONSIVE CIRCUIT CONTROL UNIT HAVING ADJUSTABLE, INTERCHANGEABLE ACTUATOR COMPONENTS AND CAM-OPERATED SWITCH

BACKGROUND OF THE INVENTION

1. Field of the Invention

This invention is directed to a pressure responsive circuit control unit having adjustable and interchangeable actuator components. The control unit incorporates a pressure responsive member of the type having a slidable piston which is normally urged toward a fully retracted position by a compression spring or the like. An actuator is secured to the piston and is adapted to selectively move a circuit control element from a normally unbiased state to a biased state in response to changes in fluid pressure as detected by the gauge.

2. Description of the Prior Art

A recent example of a gauge actuated circuit control unit is described in my U.S. Pat. No. 3,703,616, in which an indicator is reciprocably mounted for axial movement within the body of a pressure gauge in response to changes in fluid pressure. A window element is secured to and carried by the indicator and includes a conical control head integral therewith for selectively engaging the control lever of a microswitch or the like which is movable between operative and inoperative positions to selectively open and close an electrical circuit in response to changes in fluid pressure as detected by the gauge. The present invention is an improvement over this and other known gauge actuated circuit control units, wherein a piston-type pressure responsive member includes an actuator adjustably secured to and movable with the piston thereof in response to changes in fluid pressure. The actuator components are interchangeable, facilitating replacement thereof and permitting ready adaptation of the control unit to any of a variety of applications.

The present invention is operable with or without incorporation of visible indicating means, and where such are used, the actuator and circuit control element of the present invention do not interfere with the readability thereof.

SUMMARY OF THE INVENTION

The pressure responsive circuit control unit of the present invention comprises in combination a piston-type pressure responsive member or gauge, an actuator secured to and carried by the piston of the gauge, and a circuit control element movable between circuit closing and circuit opening positions in response to movement of the piston and the actuator. The preferred embodiment of the invention incorporates an indicator mounted in fixed relationship with the pressure gauge providing means for visibly indicating the position of the actuator and piston with respect thereto.

Uniformly satisfactory results have been obtained with a piston-type pressure gauge such as that disclosed in my copending application entitled: PRESSURE GAUGE HAVING INTERCHANGEABLE COMPONENTS AND POSITIVE PISTON STOP, filed Mar. 20, 1974, Ser. No. 452,791, now U.S. Pat. No. 3,910,120, wherein one end of the piston projects beyond the gauge body and carries the actuator of the present invention. The actuator generally comprises a stem secured to the projecting end of the piston and an elongate cam secured to and carried by said stem wherein the cam includes a peripheral, radially projecting, raised control surface. A circuit control element or switch is mounted in the path of movement of the cam and is selectively movable between circuit opening and circuit closing positions when engaged by said cam, thereby controlling an external electrical circuit in response to predetermined changes in fluid pressure as detected by the pressure gauge. Uniformly satisfactory results have been obtained with a microswitch or the like which is mounted in fixed relationship with the body of the gauge, wherein the switch includes a movable control arm disposed in interfering relationship with the actuator cam incident to movement of the actuator stem in response to the application of a predetermined pressure against the piston.

The actuator cam may be adapted to engage the control arm either at the specific advanced position when the gauge is subjected to fluids of a specific pressure level or continuously through an extended range of advanced positions during which the gauge is subjected to fluids of a predetermined range of pressures. One form of the invention includes a plurality of actuator cams disposed in tandem adjacent the projecting end of the piston for independently controlling a plurality of circuit control elements in response to changes in fluid pressure.

When such is desired, a calibrated indicator such as disclosed in my aforementioned co-pending application may be incorporated in the pressure responsive circuit control unit. When the indicator thereof is included in the control unit of the present invention, the actuator components do not interfere with the readability thereof.

DESCRIPTION OF THE DRAWINGS

FIG. 3 is an exploded view of the control unit, showing the interrelationship of the various components thereof.

FIG. 6 is a view similar to FIG. 1, illustrating another modification of the control unit of the present invention.

FIG. 7 is a fragmentary perspective view of a portion of the actuator and a plurality of switch means operated thereby.

DESCRIPTION OF THE PREFERRED EMBODIMENTS

Figure 1:
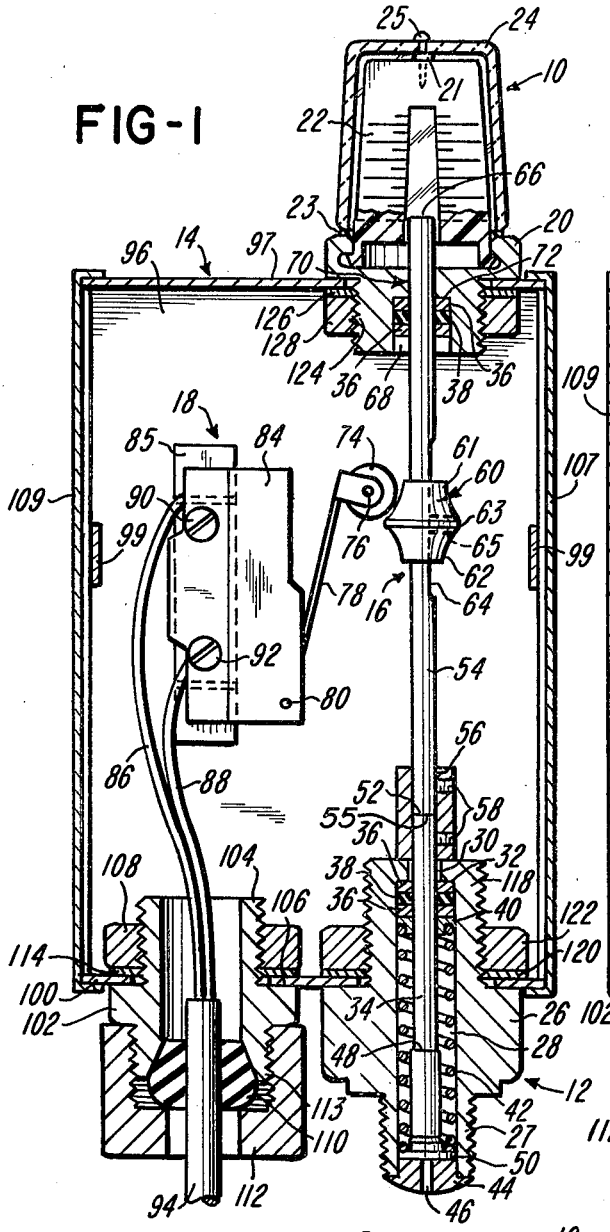
FIG. 1 is a vertical cross section of the gauge actuated circuit control unit of the present invention with the piston thereof in a fully retracted position.

The pressure responsive circuit control unit of the present invention comprises in combination a calibrated indicator 10, pressure responsive member such as, by way of example, gauge 12, housing 14, actuator 16 and circuit control element or switch 18.

The pressure gauge 12 includes an elongate body member 26 having central, axially extending bore 28 for slidably housing piston 34 which is normally urged toward a fully retracted position by compression spring 42 or the like, as illustrated in FIG. 1. End 52 of the piston projects from gauge body 26 and is adapted to carry the actuator 16 of the present invention.

Actuator 16 comprises stem 54, coupling sleeve 56 and actuator cam defined by sleeve 60. End 55 of the stem is disposed in abutting relationship with projecting end 52 of piston 34 and is fixedly secured thereto via coupling sleeve 56 and set screws 58,58. Cam 60 is located on bearing surface 64, machined or otherwise provided intermediate the length of stem 54, and adjustably secured thereto by suitable means such as set screw 65 or the like. The actuator cam includes one or more cam defining surfaces or ramps 61,62 and an intermediate control surface in the form of peripheral, raised, radially projecting band 63.

Circuit control element 18 is mounted in fixed relationship with pressure gauge 12 and is adapted to be shifted between circuit opening and circuit closing positions in response to engagement of a portion thereof by the control surface 63 of the actuator cam to change the condition of an external electrical circuit coupled thereto via connectors 86,88 in response to changes in fluid pressure as detected by said gauge. Uniformly satisfactory results have been achieved with a control element comprising microswitch 84 or the like which includes cam follower 74 secured at 76 to projecting control arm 78 and located in the path of movement of sleeve 60 of the actuator. The cam follower is adapted to be engaged by surfaces 61, 62, 63 of actuator cam 60 when piston 34 and stem 54 are sufficiently advanced with respect to gauge body 26. Control arm 78 is pivotally mounted on microswitch 84 at 80 and moves relative thereto in response to movement of the actuator.

Generally, control arm 78 is resiliently urged toward a normal, unbiased position, as shown in FIG. 1. As the pressure of the fluid entering the gauge through aperture 46 increases to a level sufficient to overcome the force of compression spring 42 and advance piston 34 to the position illustrated in FIG. 2, control surface 63 of the cam 60 engages cam follower 74 depressing control arm 78, thereby moving the circuit control element 18 from the unbiased state to the biased state and switching the element between circuit opening and circuit closing positions. It should be understood that the level of microswitch 84 may be adjusted by resetting cam 60 with respect to stem 54.

Indicator 10 is mounted in axial alignment with gauge 12 and actuator 16, wherein base 20 of the indicator includes axial bore 70 adapted to slidably receive stem 54. Calibrated scale 22 is secured to and carried by base 20 for visibly indicating the position of the stem and piston with respect to indicator 10 and therefore, gauge body 26.

Figure 2:
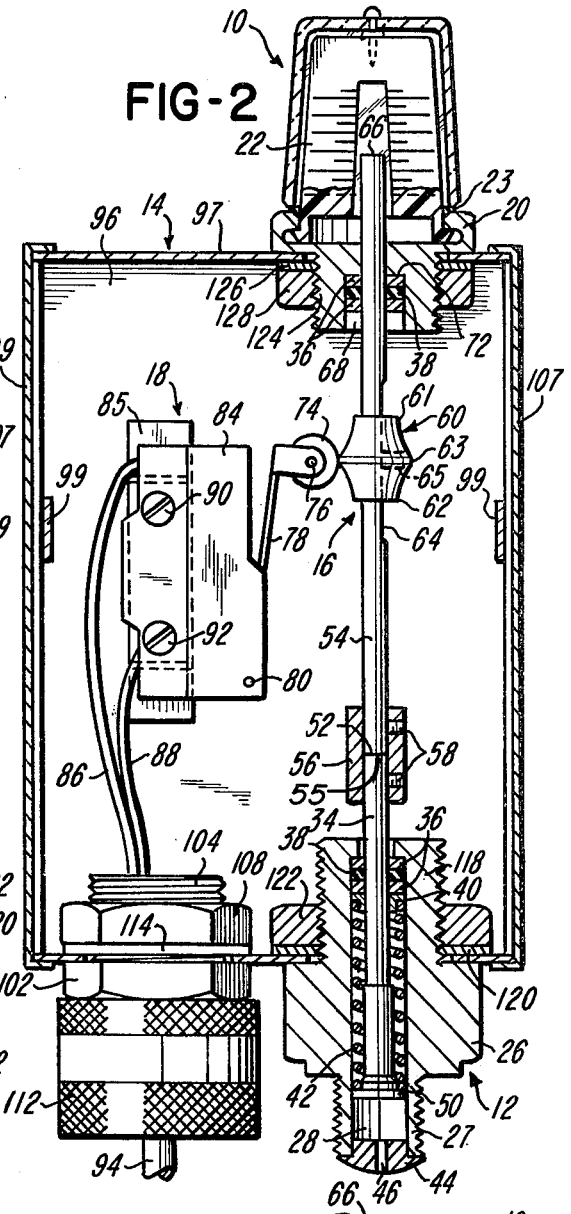
FIG. 2 is a view similar to FIG. 1, illustrating the piston in an advanced position.

The control unit of FIGS. 1 and 2 is responsive to a specific, predetermined pressure wherein the microswitch is maintained in the biased state only when the piston and stem are advanced to the specific position illustrated in FIG. 2. When the piston and stem are retracted or advanced therefrom, control surface 63 disengages follower 74 and the microswitch returns to an unbiased state.

Figure 4:
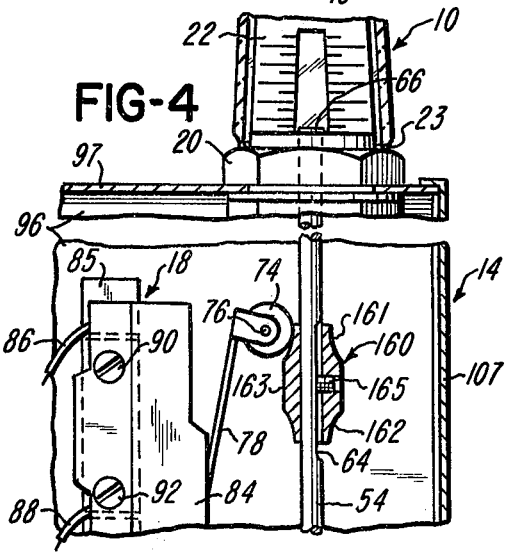
FIG. 4 is a modification of the control unit of FIG. 1, illustrating the piston in a fully retracted position.
Figure 5:
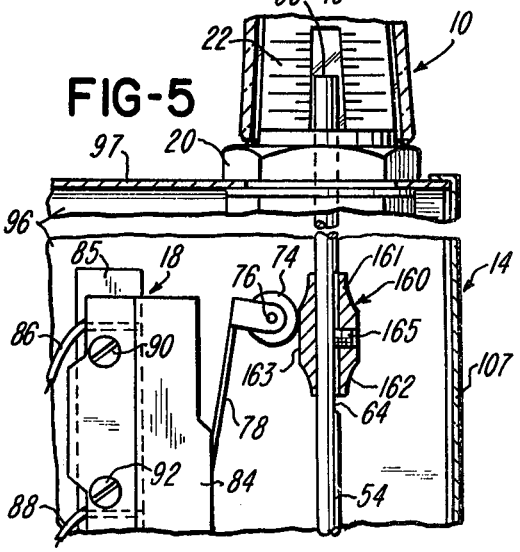
FIG. 5 is a view similar to FIG. 4, illustrating the piston in an advanced position.

A modification of the control unit is illustrated in FIGS. 4 and 5, wherein actuator 116 comprises modified cam 160 secured to stem 54 via set screws 165 and wherein the sleeve includes a pair of cam surfaces 161,162 and elongate or "dwell" control surface 163 which is operable to maintain microswitch 84 in a biased state for an extended range of pressure levels having distinct, predetermined upper and lower limits. When stem 54 is in the fully retracted position of FIG. 4, microswitch 84 is in the unbiased state as in FIG. 1. When stem 54 is advanced to the position of FIG. 5, cam follower 74 is engaged by "dwell" control surface 163 and the microswitch is biased as in FIG. 2. The microswitch remains in the biased state continuously while cam follower 74 is engaged by the elongate control surface 163.

A second modification of the control unit is illustrated in FIG. 6, wherein actuator 16 includes a pair of cams 60 and 260 to selectively engage corresponding circuit control elements 18 and 218, respectively, for controlling independent external electrical circuits in response to preselected, independent pressure levels. The cams are selectively located in tandem intermediate the length of stem 54 and are positioned to control corresponding switches 84 and 284, respectively, in response to changes in fluid pressure as detected by gauge 12. As illustrated in FIG. 6, cam 60 engages follower 74 at a lower pressure than the pressure at which cam 260 engages follower 274.

As a matter of convenience, pairs of connectors 86,88 and 286,288 may be carried to independent external control circuits via common conduit 294. Of course, it should be understood that various other combinations and modifications may be made with respect to the actuator components without departing from the scope and spirit of the present invention, wherein the various components of the actuator are interchangeable and adjustable facilitating use thereof in a variety of applications.

Housing 14 provides a suitable enclosure for the actuator components of the present invention, and where desired, may be sealed to provide a fluid-tight compartment therefor. As illustrated in FIG. 3, one section 93 comprises end walls 97 and 100 and back wall 96 of the housing whereas the other section 98 comprises side walls 107 and 109 and front wall 111 thereof, wherein a substantially complete enclosure is provided when sections 93 and 98 are disposed in proper interfitting relationship. Bracket 99, integral with section 93, provides means for securing the sections 93 and 98 in proper interfitting relationship wherein threaded post 113 is inserted through clearance opening 115 in front wall 111 and nut 118 is secured thereto, thereby enclosing the actuator and circuit control element within housing 14. Suitable means such as, by way of example, a resilient gasket or the like, may be inserted between sections 93 and 98 to effect a fluid-tight sealing relationship therebetween, where such is desired.

The housing includes integral bracket 85 secured to the inner surface of back wall 96 upon which microswitch 84 is mounted via screws 90,92 which project through clearance holes 91,93 of the switch and are secured to bracket 85 at mounting holes 87,89, respectively. Access opening 103 in wall 100 carries conduit 94 which houses connectors 84 and 88, see FIG. 1. Rubber grommet 110, or the like, is inserted in the flanged, open end of coupling 102 and nut 112 is secured to threaded end portion 119 thereof, securing the grommet and conduit assembly therein. Grommet 110 provides a satisfactory seal between coupling 102 and nut 112, where such is desired. Threaded end portion 104 of coupling 102 is inserted through access opening 103 and lock washer 106 and nut 108 are secured thereto, completing the conduit and coupling assembly.

When the two sections of housing 14 are assembled, access openings 101 and 105 are disposed in axial alignment with one another and provide means for properly aligning indicator 10 with gauge 12. Threaded end portion 118 of gauge body 26 is inserted through access opening 105 and lock washer 120 and nut 122 are secured thereto, thereby mounting the gauge on housing 14. Threaded end portion 124 of the indicator is inserted through access opening 101 and receives end 66 of stem 54, as illustrated in FIG. 1. Lock washer 126 and nut 128 are secured to end 124, thereby mounting indicator 120 on housing 14 in axial alignment with gauge 12. It should be understood that control unit of the present invention can be utilized with or without indicator 10 without departing from the scope and spirit of the present invention. However, as here illustrated, when an indicator is incorporated in the circuit control unit of the present invention, the actuator components thereof do not interfere with the readability thereof.

Seals such as neophrene O-rings or the like may be inserted between housing 14 and the various members extending through the access openings therein, and with the aforementioned gasket provided at the seam between sections 93 and 98, provide a substantially sealed, fluid-tight enclosure for the circuit control element and the actuator components of the present invention.

The pressure gauge 12 comprises an elongate body 26 having a central bore 28 extending axially therethrough for reciprocably housing piston 34, see FIG. 1. The body terminates in opposite threaded end portions 27 and 118, wherein end 27 provides suitable means for securing the gauge to a source of pressure to be measured, and end portion 118 provides means for mounting the gauge on housing 14, as described. Upper end 30 of bore 28 is of reduced diameter, defining shoulder 32 which forms a positive stop for the piston. A self-lubricating seal such as, by way of example, the lubricant saturated bushings 36,36 on either side of a neophrene O-ring 38 is inserted in the bore and abuts shoulder 32. Keeper 40 is disposed in abutting relationship with the end face of exposed bushing 36. Compression spring 42 is inserted in the bore with opposite ends thereof seated in spring keeper 40 and against flange 50 of the piston, thereby normally urging the piston toward a fully retracted position as shown in FIG. 1. Shoulder 48, intermediate the length of piston 34, is of a diameter larger than the opening of the reduced portion 30 of the bore, precluding passage of that portion of the piston therethrough.

Plug 44 is inserted in and forms a snug, slip-fit relationship with the lower, open end of bore 28 and releasably maintains the gauge components within body 26. Central aperture 46 in plug 44 is in open communication with the interior of bore 28, providing access of the gauge to a source of fluid pressure to be measured.

End 52 of piston 34 projects axially outward from end portion 118 of gauge body 26 into housing 14 and is adapted to receive stem 54 of the actuator, as described herein.

Indicator 10 includes base 20, planar, calibrated scale 22 longitudinally projecting upward from the base, and transparent cover 24, secured to scale 22 by drive screw 25, and substantially encasing the indicator components. Seal 21 is inserted between cover 24 and scale 22, and seal 23 is inserted between cover 24 and indicator body 20, thereby providing a substantially fluid-tight sealing relationship between the scale, the base and the cover, where such is desired. Depending end portion 124 of body 20 includes an axially extending bore 68 adapted to receive end 66 of stem 54. Reduced portion 70 of the bore defines shoulder 72 and provides a seat for bushings 36,36 and O-ring 38.

In FIG. 7 a further modification of the invention utilizes a single cam means 60 to actuate a plurality of switches 78*a* and 78*b*.

From the foregoing it will be noted that I have provided a gauge actuated circuit control unit having adjustable and interchangeable components, wherein the control unit is designed to operate with or without visible indicating means. Where such an indicator is used, the actuator components do not interfere with the readability thereof.

What is claimed is:

1. Combination pressure actuated switch and gauge, comprising: a housing having aligned openings in opposite, spaced walls thereof; a pressure responsive device mounted in the opening in one wall and including a body having a bore therethrough and a reciprocable pressure responsive member in the bore including a rod portion extending out of the bore and into the housing; a pressure indicating scale mounted in the opening in the other wall and extending exteriorly of the housing and having a bore therein aligned with the bore in said body; an elongate actuator stem within the housing having one end thereof secured to the rod in coaxial, justaposed relationship therewith for movement with the rod, the other end of the actuator stem slidably extending into the bore in the scale and cooperable therewith to indicate pressure sensed by the pressure responsive member; cam means secured on the actuator stem between the ends thereof; and electrical switch means disposed within said housing and including switch actuator means situated in the path of movement of the cam means so as to be actuated thereby upon predetermined movement thereof.

2. A device as called for in claim 1, wherein: the housing has top, bottom and side walls, said openings being in the top and bottom walls; means releasably securing the body in the opening in the bottom wall; and means mounting said switch means entirely within the interior of the housing.

3. A device as called for in claim 2, wherein: said actuator stem is movable between an extended position and a retracted position; the length of the stem is such that when in a fully retracted position the said other end thereof projects from and extends beyond the top wall of the housing for cooperation with the scale exteriorly of the housing to indicate axial travel of the stem.

4. A device as called for in claim 1, wherein: said cam means comprises at least one cam member adjustably movably secured on the actuator stem, said cam member having oppositely sloping, inwardly tapered ramp portions at opposite ends thereof, and a substantially constant diameter control surface between the ramps; and adjusting means adustably securing the cam member to the stem, said adjusting means comprising a flattened portion of the stem extending longitudinally thereof and defining an elongate bearing surface, and a set screw extended through the cam member into engagement with the stem, releasably securing the cam member in axially adjusted position along the lengh of the bearing surface.

5. A device as called for in claim 1, wherein: coupler sleeve means is disposed in surrounding relationship with the justaposed ends of the stem and rod, and set screws extended through the sleeve means into engagement with the ends of the stem and rod.

6. A device as called for in claim 1, wherein: the body and scale are sealed in their respective openings and the stem and rod are each slidably sealed in their respective bores.

7. A device as called for in claim 3, wherein a transparent cover completely encompasses the free outer end of the actuator stem and scale.

8. A device as called for in claim 7, which includes means for sealing the interior of said housing and cover against the accidental or unintentional introduction of gaseous or fluid media thereinto.

9. A device as called for in claim 7, wherein at least two electric switches are located within the housing, and wherein the actuator stem is provided with a single cam for actuating the control member of all switches.

10. A device as called for in claim 7, wherein at last two electric switches are located within the housing, and wherein a separate cam for the control member of each switch is secured to and carried by the actuator stem.

11. A device as called for in claim 3, wherein one or more of the side walls of the housing are removable for providing access to the switch, cam and actuator stem.

12. A device as called for in claim 11, which includes means for securing the cam to and in predetermined axial relationship with said stem.

* * * * *